United States Patent [19]

Kelley

[11] Patent Number: 4,618,192

[45] Date of Patent: Oct. 21, 1986

[54] CABINET WITH HANGER RAILS

[75] Inventor: James O. Kelley, Spring Lake, Mich.

[73] Assignee: Herman Miller, Inc., Zeeland, Mich.

[21] Appl. No.: 711,975

[22] Filed: Mar. 14, 1985

[51] Int. Cl.[4] ..... A47B 67/02

[52] U.S. Cl. ..... 312/245; 108/152; 248/220.2; 248/225.2

[58] Field of Search ..... 312/245, 246, 321; 108/152; 248/222.2, 222.3, 220.2, 225.2, 225.1; 211/94, 87, 90

[56] References Cited

U.S. PATENT DOCUMENTS

| | | | |
|---|---|---|---|
| 4,033,652 | 7/1977 | O'Brian | 312/245 |
| 4,133,507 | 1/1979 | Chervenak | 312/245 |
| 4,155,459 | 5/1979 | Marschak | 211/94 X |
| 4,349,113 | 9/1982 | Schreiner | 211/103 |
| 4,401,222 | 8/1983 | Kulikowski et al. | 211/94 |
| 4,457,436 | 7/1984 | Kelley | 312/246 |

*Primary Examiner*—James T. McCall

*Attorney, Agent, or Firm*—Varnum, Riddering Schmidt & Howlett

[57] ABSTRACT

A cabinet (10) is adapted to be supported by vertical slotted standards (28) and comprises a top wall (12), a bottom wall (14), two identical side walls (16), a back wall (18) and a plurality of brackets (70) secured to the rearward edges (68) of the side walls (16) and adapted to engage the slots (32) of the vertical standards (28) and thereby hang the cabinet (10) therefrom. An extruded member (20) is secured to the back wall (18) and forms a plurality of vertically disposed horizontal hanger rails (22) having indentations (54) forming lips (46). Work accessories, such as a pair of bookends (24) and a variety of organizers such as trays (26), are removably mounted on the rails (22) through hooks (38) which rest on the lips (46) and in the indentations (54) of the rails (22).

14 Claims, 2 Drawing Figures

CABINET WITH HANGER RAILS

FIELD OF THE INVENTION

This invention relates to wall-mountable cabinets of the type employed in offices, medical facilities and the like and is particularly adapted for modern modular office partitioning systems of the so-called "open plan" type.

BACKGROUND OF THE INVENTION

In modular office designs and other modern office systems it is desirable to have cabinets which are not only wall mountable but which also incorporate therein a system for organizing papers, folders, books, among other items normally associated with business activities. Since organization of work space in modern office systems is vital to work space efficiency and to obtaining a quality work product, a means within a cabinet which promotes such organization is very desirable.

In the past, wall-mountable cabinets have been available. However, these cabinets have interior spaces which lack the ability to organize books, papers, folders and the like. The only cabinets available that have incorporated internal organizing systems have been of the freestanding variety. For example, the U.S. Pat. No. Re. 28,994 to Aylworth, reissued Oct. 5, 1976, shows a cabinet adapted to be mounted on a wall and having a pair of brackets secured to the rear edges of the side walls of the cabinet. Each bracket has a series of downwardly-depending hooks adapted to be received within the slots of vertical standards mounted to the wall. However, Aylworth's cabinet does not incorporate an organization system of the type discussed above.

The U.S. Pat. No. 4,274,687 to Bayles et al, issued June 23, 1981, discloses a freestanding cabinet incorporating a series of horizontally stacked rails. Storage bins and trays are removably mounted to the rails by downwardly-depending lips secured to the bins and trays and which hook over the rails. However, Bayles et al do not disclose a cabinet having hooks adapted to be mounted within the slots of vertical standards of the type commonly employed in modern office systems. Similarly, the U.S. Pat. No. 4,174,486 to Winkler, issued Nov. 13, 1976, discloses an adjustable shelving and storage system wherein a cabinet has a plurality of rails secured to the back wall of the cabinet. However, like the cabinet in Bayles et al, Winkler's cabinet is not wall mountable.

SUMMARY OF THE INVENTION

In contrast to the foregoing references, this invention comprises a cabinet which not only incorporates a system for organizing papers, books, folders and the like but is also adapted to be mounted within the slots of vertically disposed standards secured to the walls of a building or to the freestanding panels forming the partitions in an open-plan office system.

This invention provides a cabinet having an upper wall, a bottom wall, two side walls and a back wall. The cabinet incorporates therein a series of hanger rails formed of a single extruded member adapted to receive a variety of work accessories such as bookends, trays and the like.

In a preferred embodiment, the extrusion forming the hanger rails is securely attached to the back wall of the cabinet. Each rail is identical with the others and includes an indentation and an upwardly- and inwardly-depending lip. In another embodiment, the extrusion forming the hanger rails also forms the back wall of the cabinet.

In a preferred embodiment, the invention relates to wall-mounted cabinets. In this regard, the cabinet is adapted to hang from vertical slotted standards of the type mounted to the interior walls of a building or to the freestanding walls forming partitions in an open-plan office system. Accordingly, attached to the cabinet is a least one mounting bracket having a plurality of rearwardly projecting downwardly depending tabs adapted to engage the slots of the standards.

The rails are secured to the back wall of the cabinet by a plurality of screws which extend through a corresponding number of openings in the terminal ends of the rails and a corresponding number of apertures, aligned with the openings, in the back wall of the cabinet. The work accessories are removably mounted to the rails by hooks connected to the inward ends of the accessories and resting on and mating with the upwardly-and inwardly-projecting lips of the rails.

BRIEF DESCRIPTION OF THE DRAWINGS

The invention will now be described with reference to the drawings in which.

DESCRIPTION OF THE PREFERRED EMBODIMENTS

Figure 1:
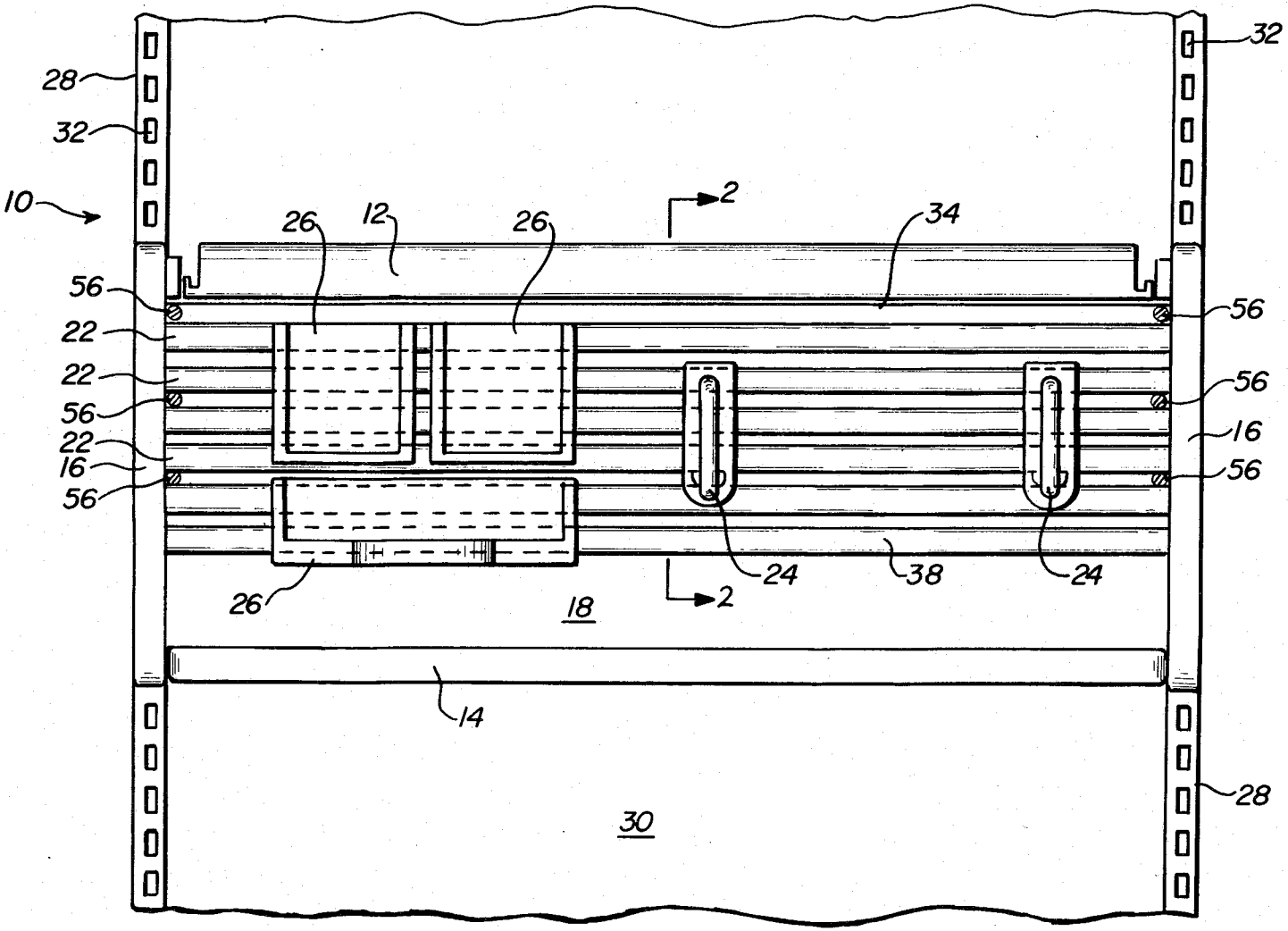
FIG. 1 is a front elevational view of the cabinet of the invention incorporating hanger rails.

Referring to the drawings in detail, there is shown a cabinet 10 having a top wall 12, a bottom wall 14, two identical side walls 16 and a back wall 18. An extruded member 20, forming a plurality of hanger rails 22, is securely attached to the back wall 18 of cabinet 10. Work accessories, such as bookends 24 and trays 26, are removably supported on the rails.

In the preferred embodiment, the cabinet 10 is adapted to hang from a pair of vertical slotted standards 28 of the type typically mounted to the interior wall of a building or to a freestanding wall of a modern modular office system of the so-called "open plan" type, the interior wall or freestanding wall being represented by reference number 30. To this end, the cabinet 10 has attached to and extending from the rearward edges 68 of each side wall 16 a plurality of brackets 70 with each bracket having a plurality of linearly aligned, equidistantly spaced tabs 72, similar to those disclosed in the U.S. Pat. No. 4,171,789 to VanderHoek et al, issued Oct. 23, 1979. Hogue U.S. Pat. No. 4,387,872, issued June 14, 1983, and Boundy et al U.S. Pat. No. 4,013,254, issued Mar. 22, 1977, adapted to be detachably received within the slots 32 of the vertical standards 28.

Figure 2:
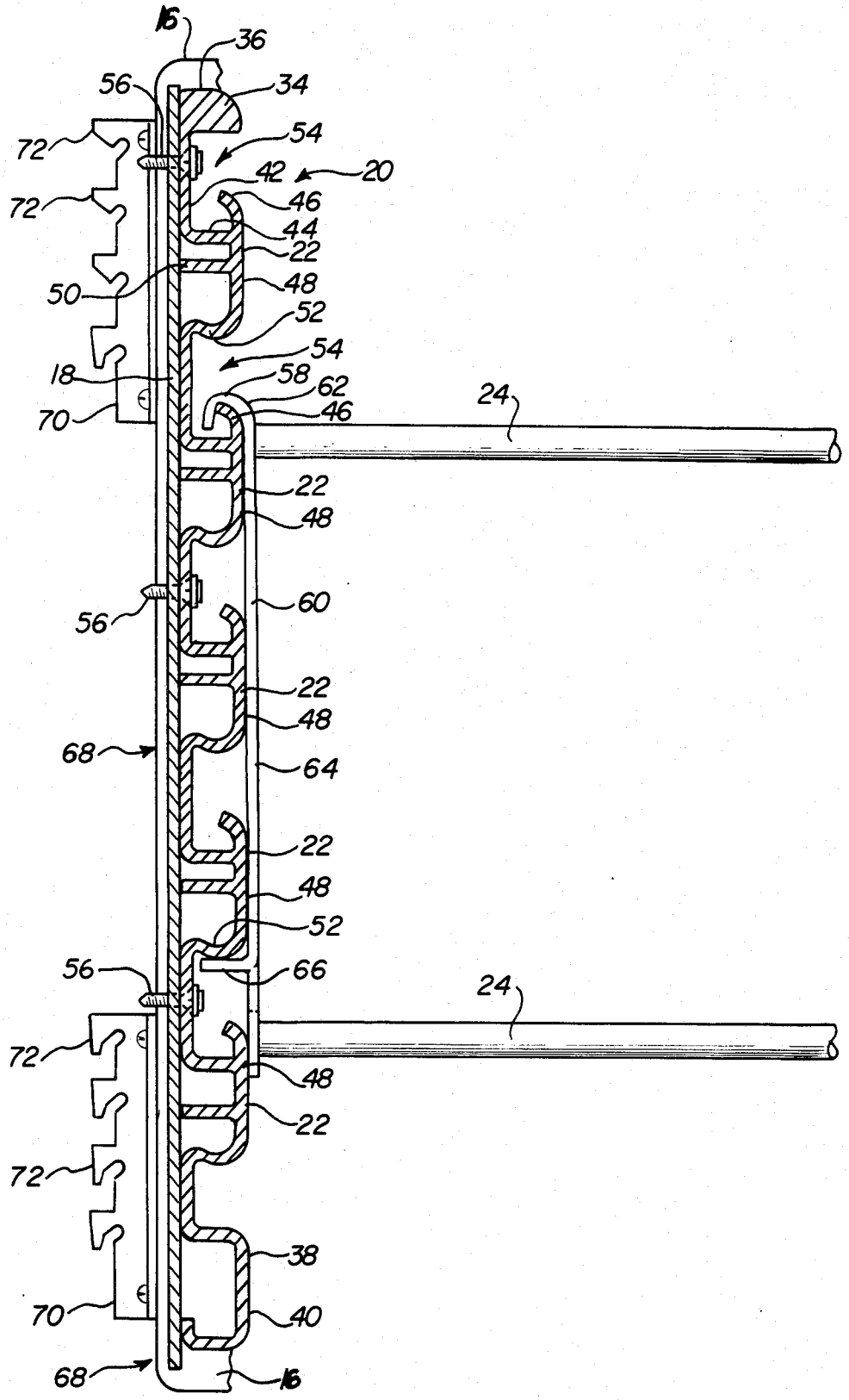
FIG. 2 is a cross-sectional view of the back wall of the cabinet taken along line 2—2 of FIG. 1.

As shown in FIG. 2, the extruded member 20 is a unitary member and forms an outwardly-projecting, decorative flange 34 at its top portion 36, a decorative and substantially rectangular, in cross-section, bar 38 at its bottom portion 40, and a plurality of hanger rails 22 positioned in vertically spaced relationship therebetween. Each hanger rail 22 comprises a vertical portion 42 engaging back wall 18; an outwardly- and horizontally-extending leg 44 integral with vertical portion 42; an upwardly- and inwardly-extending lip 46 integral with leg 44; a vertical face 48 also integral with leg 44; a horizontal support 50 perpendicular to and integral with vertical face 48 and in abutting engagement with the back wall 18; and a curved leg 52 integral with the face 48 and substantially perpendicular to and integral with the vertical portion 42 of a neighboring rail 22. The vertical portion 42 forms an indentation 54 above leg 44 and lip 46.

In the preferred embodiment, the extruded member 20 is rigidly secured to cabinet 10 by a plurality of screws 56 extending through a plurality of holes (not shown) in the terminal ends of the vertical portions 42 of extruded member 20 and a corresponding number of apertures (not shown) in the back wall 18 and aligned with the openings. It is understood, however, that extruded member 20 can be secured to back wall 18 by any suitable mechanical technique such as bolting or welding.

In one embodiment of the invention, the extruded member 20 not only forms a series hanger rails 22, but it also functions as a back wall of the cabinet, in which case back wall 18 is unnecessary.

The work accessories removably engage hanger rails 20 through downwardly-depending hooks 58 which mate with the upwardly- and inwardly-depending lips 46 of the rails 22. For example, as shown in FIG. 2, each bookend 24 has a rear wall 60 having formed at its top part 62 a downwardly- depending hook 58 removably received upon the lip 46 and within the indentation 54 of the rail 22 and horizontally supported therefrom. Rear wall 60 of bookend 24 is held stationary in the vertical plane by its body 64 which rests vertically against the faces 48 of the vertically disposed rails 22. In addition, the rear wall 60 can have a rearwardly- projecting segment 66 which is adapted to rest snugly under a curved leg 52 and within an indentation 54 of a rail 22 to prevent upward vertical movement of the bookend to prevent inadvertent derailment of the hook 58 from the lip 46 of rail 22.

As indicated above, and as shown in FIG. 1, extruded member 20 forms a series of vertically positioned rails which span nearly the total height of the back wall 18, with each rail spanning substantially the entire width of the back wall. In this manner, work accessories can be hung anywhere along the length of the rails and at various heights on the rails and within the cabinet to accommodate (1) varying physical characteristics of workers utilizing the cabinet, (2) work accessories of varying number and geometric size and (3) the design of a variety of organizational schemes.

Although not shown in the drawings, cabinet 10 can include a flipper door, similar to that disclosed in the U.S. Pat. No. 28,994 to Aylworth, reissued Oct. 5, 1976, mounted to the upper wall 12 and side wall 16 of the cabinet. The flipper door can be raised to a stored position overlying upper wall 12 while the cabinet is in use and can be lowered for covering the contents of the cabinet when the same is not in use to give the office system, of which the cabinet is a part, a clean-sparton appearance.

In the preferred embodiment, the rails are made of a single piece of extruded aluminum. It is understood, however, that the rails can be formed from other materials, such as various types of plastics.

While the invention will be described in connection with a preferred embodiment, it will be understood that I do not intend to limit the invention to that embodiment. To the contrary, I intend to cover all alternatives, modifications and equivalents as may be included within the spirit and scope of the invention as defined by the appended claims.

The embodiments of the invention in which an exclusive property or privilege is claimed are defined as follows:

1. In a wall-mountable cabinet, the combination of a top wall, a bottom wall, two side walls and a back wall; at least one mounting bracket secured to the cabinet and having a plurality of rearwardly-projecting and downwardly-depending tabs adapted to engage slotted vertical standards mounted to the wall; and a rail means secured to said back wall, comprising a plurality of vertically spaced, horizontal hanger rails spanning substantially the width and height of said back wall and for removably hanging work accessories;

whereby said work accessories can be hung at a variety of horizontal and vertical positions on said hanger rails and within said cabinet.

2. A cabinet according to claim 1 wherein said hanger rails are formed from a single extruded member and each of said rails includes an indentation and a lip.

3. A cabinet according to claim 2 wherein the cabinet further comprises at least one work accessory which includes a hook portion adapted to engage said lip and rest within said indentation.

4. A cabinet according to claim 3 wherein said extruded member is made of aluminum.

5. A cabinet according to claim 3 wherein said extruded member is made of plastic.

6. A cabinet according to claim 1 wherein said hanger rails are formed from a single extruded member which spans substantially the entire height of the back wall and wherein each hanger rail comprises a vertical portion engaging the back wall; a horizontal leg integral with the vertical portion; an upwardly- and inwardly-depending lip integral with the horizontal leg; a face integral with the vertical portion and the horizontal leg; a support perpendicular to and integral with the face and engaging the back wall; and a curved leg integral with and substantially perpendicular to the face and the vertical portion of a neighboring rail.

7. A cabinet according to claim 6 wherein the cabinet further comprises at least one work accessory which includes a hook portion adapted to mate with said upwardly- and inwardly-depending lip.

8. A cabinet according to claim 7 wherein said extruded member is made of aluminum.

9. A cabinet according to claim 7 wherein said extruded member is made of plastic.

10. In a wall-mountable cabinet, the combination of a top wall, a bottom wall, and two side walls; at least one mounting bracket secured to the cabinet and having a plurality of rearwardly-projecting and downwardly-depending tabs adapted to engage slotted vertical standards mounted to the wall;

and a rail means forming a back wall of the cabinet comprising a plurality of vertically spaced, horizontal hanger rails spanning substantially the width and height of said back wall and for removably hanging work accessories;

whereby said work accessories can be hung at various horizontal and vertical positions on said hanger rails and within said cabinet.

11. A cabinet according to claim 10 wherein said hanger rails are formed from a single extruded member and each of said rails includes an identation and a lip.

12. A cabinet according to claim 11 wherein the cabinet further comprises at least one work accessory which includes a hook portion adapted to engage said lip and rests within said identation.

13. A cabinet according to claim 12 wherein said extruded member is made of aluminum.

14. A cabinet according to claim 13 wherein said extruded member is made of plastic.

* * * * *